US008688011B2

(12) United States Patent
Ochiai

(10) Patent No.: US 8,688,011 B2
(45) Date of Patent: Apr. 1, 2014

(54) DEVELOPING DEVICE, IMAGE FORMING APPARATUS, AND IMAGE FORMING METHOD

(75) Inventor: Norikazu Ochiai, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 354 days.

(21) Appl. No.: 13/116,225

(22) Filed: May 26, 2011

(65) Prior Publication Data

US 2012/0008987 A1 Jan. 12, 2012

Related U.S. Application Data

(60) Provisional application No. 61/362,438, filed on Jul. 8, 2010.

(51) Int. Cl.
*G03G 15/08* (2006.01)
*G03G 15/09* (2006.01)

(52) U.S. Cl.
CPC ..... *G03G 15/0822* (2013.01); *G03G 15/0928* (2013.01)
USPC ..... 399/254

(58) Field of Classification Search
CPC ..... G03G 15/0822; G03G 15/0928
USPC ..... 399/254, 267, 279, 282
See application file for complete search history.

(56) References Cited

U.S. PATENT DOCUMENTS

2006/0245791 A1* 11/2006 Tatsumi et al. ..... 399/254
2012/0243911 A1* 9/2012 Iwamura ..... 399/254

FOREIGN PATENT DOCUMENTS

JP 2011-43635 3/2011

* cited by examiner

*Primary Examiner* — Walter L Lindsay, Jr.
*Assistant Examiner* — Rodney Bonnette
(74) *Attorney, Agent, or Firm* — Amin, Turocy & Watson, LLP

(57) ABSTRACT

An image forming apparatus includes: a photoconductive drum; a mixer which stirs a developer; and a developing roller which has plural magnets to supply the stirred developer to the photoconductive drum, and a separation pole that is a magnet arranged opposite the photoconductive drum in relation to a rotational center axis and separating the developer supplied to the photoconductive drum, and which is arranged in a way that a vertical first tangential line on the separation pole side is located outward to the separation pole side from an outer circumference of the mixer.

14 Claims, 3 Drawing Sheets

DEVELOPING DEVICE, IMAGE FORMING APPARATUS, AND IMAGE FORMING METHOD

CROSS-REFERENCE TO RELATED APPLICATION

This application is based upon and claims the benefit of priority from the prior the U.S.A. Patent Application No. 61/362,438, filed on Jul. 8, 2010, and the entire contents of which are incorporated herein by reference.

FIELD

Embodiments described herein relate generally to a developing device, an image forming apparatus, and an image forming method.

BACKGROUND

In an electronic image forming apparatus such as a printer or copy machine, a developer is supplied by a developing device to an electrostatic latent image on a photoconductive drum and a developer image is generated.

This developing device includes a developing roller which supplies the developer to the photoconductive drum, and a mixer which stirs a carrier and a toner and supplies the developing roller with the developer acquired by this stirring.

The developing roller has plural magnets within a rotating outer roller. The developing roller catches the developer using catching pole, which is one of the plural magnets, then supplies the developer to the photoconductive drum using another magnet, and separates the used developer from the outer roller using another magnet.

In the related art, the used developer that is separated may adhere to the catching pole. The used developer that is separated has low toner content. Therefore, supplying the used developer to the photoconductive drum may deteriorate image quality.

In view of this point, a technique of providing a control plate to prevent the collected used developer from being drawn to the catching pole of the developing roller is proposed.

However, this technique requires high accuracy in the spacing between the developing roller and the control plate and therefore needs a number of processes for assembly and an increased number of components.

Thus, there is demand for a developing device, an image forming apparatus and an image forming method such that adherence of the used developer separated from the developing roller to the catching pole can be prevented efficiently.

DETAILED DESCRIPTION

Throughout this description, the embodiments and examples shown should be considered as exemplars, rather than limitations on the apparatus and methods of the present embodiments.

Hereinafter, an embodiment of a developing device, an image forming apparatus and an image forming method will be described in detail with reference to the drawings. Here, the image forming apparatus encompasses a copy machine, MFP (multi-function peripheral) and printer.

The image forming apparatus of this embodiment includes: an image carrier; a developing roller which rotates around a rotational center axis, supplies a developer to the image carrier, using a developing pole that is a magnetic pole arranged within the developing roller to face the image carrier, and separates the developer, using a separation pole that is a magnetic pole arranged downstream of the developing pole along a direction of rotation within the developing roller; and a mixer which is arranged below the developing roller in a way that an outer circumference of the mixer is located more toward the image carrier side than a first tangential line to a point of intersection between a horizontal diameter of the developing roller and an outer circumference thereof on the separation pole side, and which stirs the developer.

Figure 1:
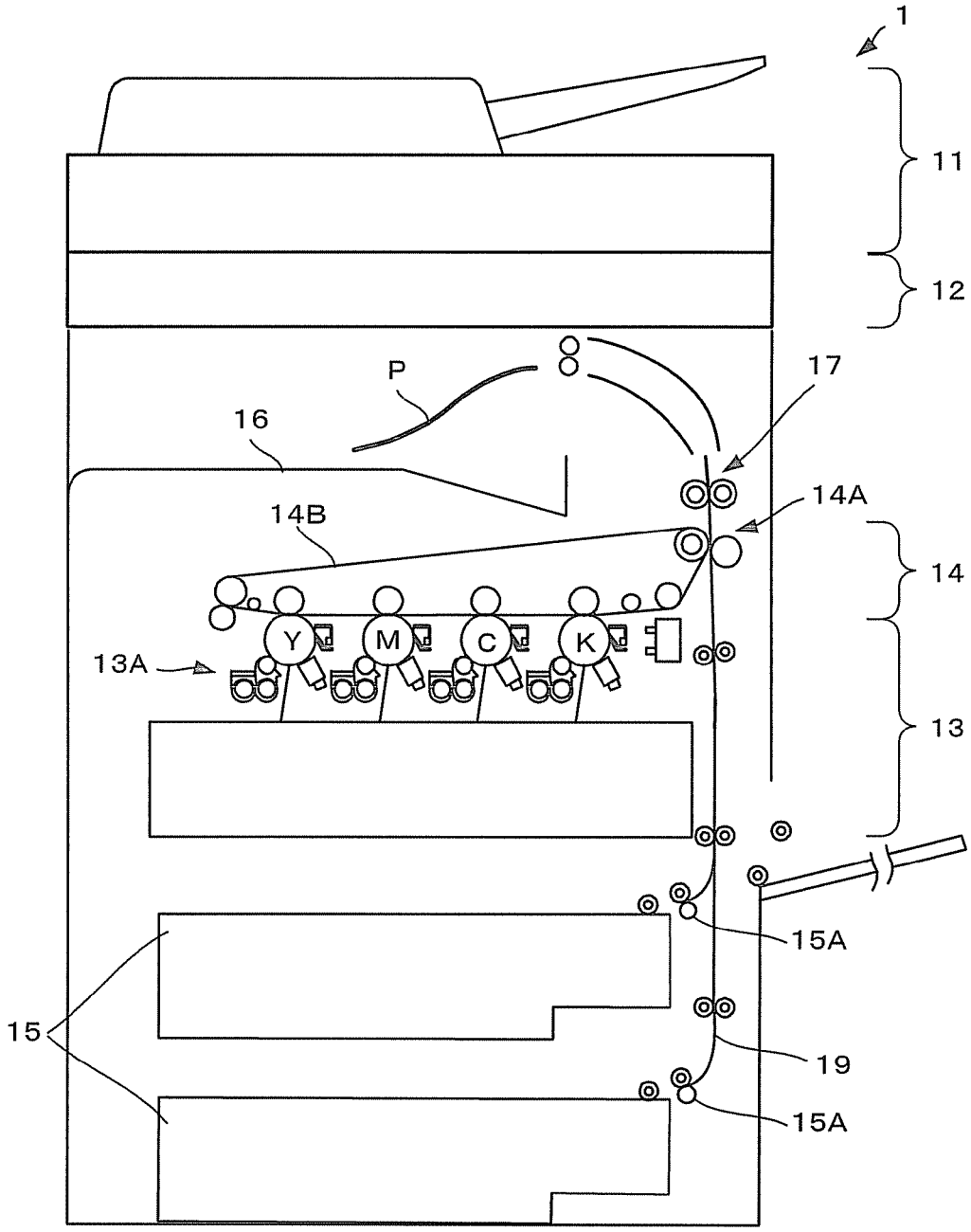
FIG. 1 shows the configuration of an image forming apparatus.

FIG. 1 shows the configuration of an image forming apparatus 1 of this embodiment. As shown in FIG. 1, the image forming apparatus 1 includes an automatic document feeder 11, an image reading unit 12, an image forming unit 13, a transfer unit 14, a recording medium carrying mechanism 19, and a paper supply unit 15.

The image forming apparatus 1 has the automatic document feeder 11 on top of the body in away that allows opening and closing. The automatic document feeder 11 has a document carrying mechanism which takes out document sheets, one by one, from a paper supply tray and carries the sheets to a paper discharge tray.

With the document carrying mechanism, the automatic document feeder 11 carries document sheets, one by one, to a document reading part of the image reading unit 12. Alternatively, the automatic document feeder 11 can be opened and a document can be placed on a document table of the image reading unit 12.

The image reading unit 12 has a carriage including an exposure lamp to expose light to a document and a first reflection mirror, plural second reflection mirrors retained to the body frame of the image forming apparatus 1, a lens block, and a CCD (charge coupled device) as an image reading sensor.

The carriage stands still in the document reading part or reciprocates below the document table and reflects light of the exposure lamp reflected from the document, to the first reflection mirror. The plural second reflection mirrors reflect the reflected light from the first reflection mirror to the lens block. The lens block outputs the reflected light to the CCD. The CCD converts the incident light to an electrical signal and outputs the electrical signal as an image signal to the image forming unit 13.

The image forming unit 13 has a laser casting unit, a photoconductive drum as an image carrier, and a developing device 13A, for each of yellow Y, magenta M, cyan C and black K.

The laser casting unit, which is an electrostatic latent image forming unit, casts a laser beam to the photoconductive drum based on an image signal and forms an electrostatic latent image on the photoconductive drum. A developer supply unit supplies a developer to the photoconductive drum and forms a developer image from the electrostatic latent image.

The recording medium carrying mechanism 19 has a pickup mechanism 15A which takes out recording media, one by one, at the most upstream part on the paper supply unit 15 side.

The pickup mechanism 15A takes out recording media, one by one, from the paper supply unit 15 and delivers the recording media to the recording medium carrying mechanism 19. The recording medium carrying mechanism 19 carries the recording media to the transfer unit 14.

The transfer unit 14 has a transfer belt 14B, a transfer roller 14A, and a fixing device 17. The transfer belt 14B is laid over a counter-roller that faces the transfer roller 14A. The transfer belt 14B, as an image carrier, receives the developer image transferred from the photoconductive drum and carries the developer image. The transfer roller 14A applies a voltage to transfer the developer image on the transfer belt 14B to the recording medium that is carried thereto. The fixing device 17 heats and pressurizes the developer image and thus fixes the developer image to the recording medium.

In another embodiment of the image forming apparatus 1, the developer image is transferred directly from the photoconductive drum to the recording medium. In this case, the transfer roller 14A is arranged facing the photoconductive drum.

The recording medium P discharged from a paper discharge port is stacked on a paper discharge tray 16 as a holding unit which holds the recording medium.

Figure 2:
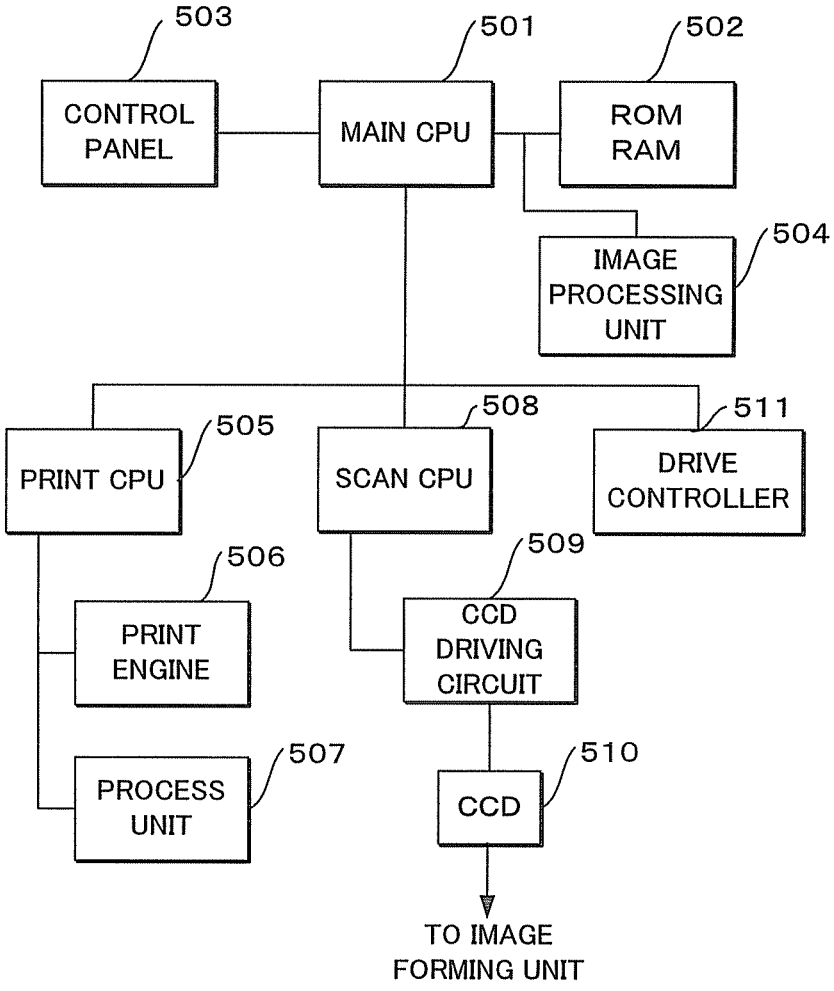
FIG. 2 is a block diagram showing the configuration of the image forming apparatus.

FIG. 2 is a block diagram showing the configuration of the image forming apparatus 1. As shown in FIG. 2, the image forming apparatus 1 has a main CPU 501 as a control unit, a control panel 503 as a display input device, a ROM and RAM 502 as a storage device, and an image processing unit 504 which carries out image processing.

The main CPU 501 connects to and controls a print CPU 505, a scan CPU 508 and a drive controller 511 provided in the image forming apparatus 1.

The print CPU 505 connects to and controls a print engine 506 which carries out image formation and a process unit 507 including the transfer device.

The scan CPU 508 controls a CCD driving circuit 509 which drives a CCD 510. An output of the CCD 510 is outputted to the image forming unit.

The drive controller 511 controls the recording medium carrying mechanism 19.

Figure 3:
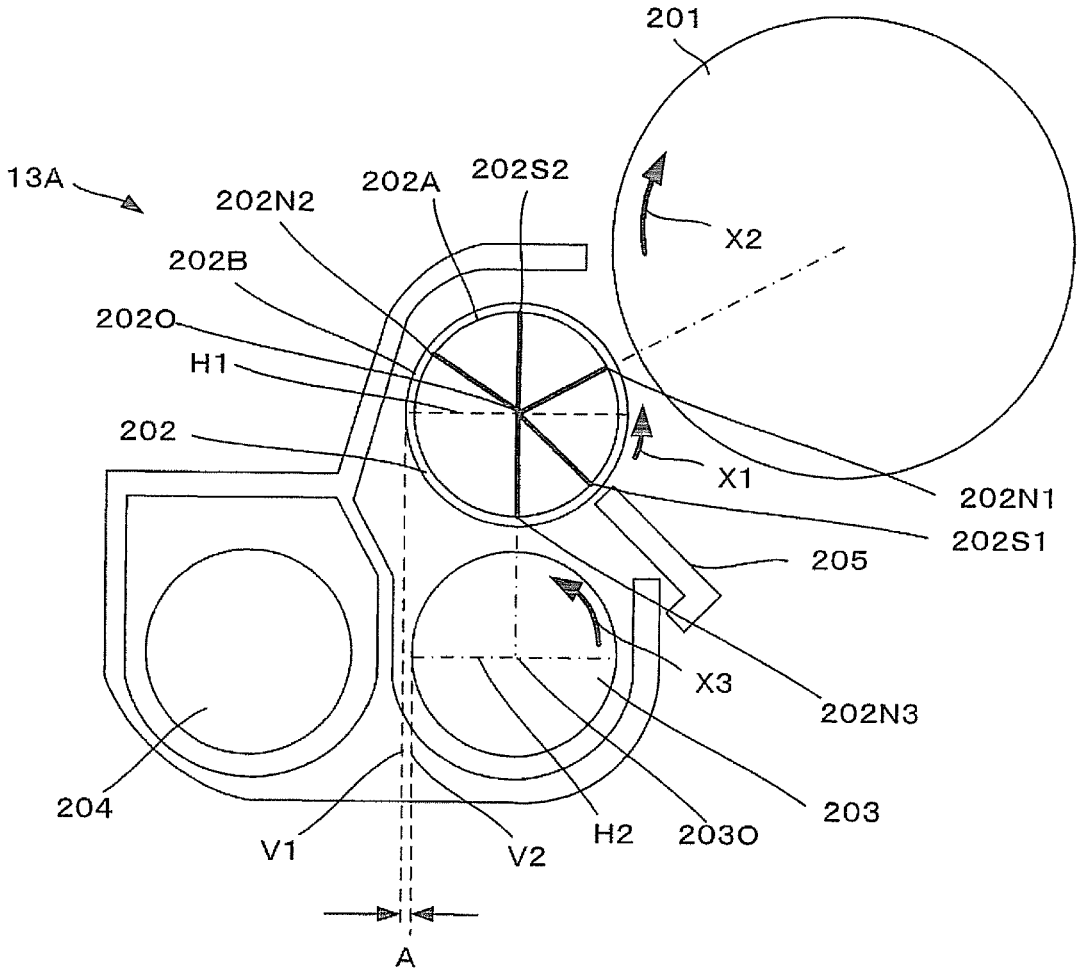
FIG. 3 is a side view of the vicinity of a developing device.

FIG. 3 is a side view of the vicinity of the developing device 13A. As shown in FIG. 3, the developing device 13A has a first mixer 203 and a second mixer 204 which stir a carrier and a toner to generate a developer, and a developing roller 202 which supplies the developer to a photoconductive drum 201.

The image forming apparatus 1 has the first mixer 203 below the developing roller 202. The center 203O of the first mixer 203 falls within a range perpendicular to a horizontal diameter H1 passing through the center of the developing roller 202.

The developing roller 202 has plural magnets in an inner part 202A, and an outer roller 202B rotating in the direction of arrow X1 outside of the plural magnets. Specifically, the developing roller 202 has: a catching pole 202N3, which is a magnet having a magnetic pole N at the closest point to the first mixer 203; a regulating pole 202S1, which is a magnet having a magnetic pole S at the closest point to a regulating plate 205 which regulates the amount of the developer caught by the catching pole 202N3, downstream of the catching pole 202N3 in the direction of rotation of the developing roller 202; a developing pole 202N1, which is a magnet having a magnetic pole N at the closest point to the photoconductive drum 201, downstream of the regulating pole 202S1 in the direction of rotation of the developing roller 202; a carrying pole 202S2, which is a magnet having a magnetic pole S downstream of the developing pole 202N1 in the direction of rotation of the developing roller 202; and a separation pole 202N2, which is a magnet having a magnetic pole N above the horizontal line H1 passing through the rotational center axis 202O of the developing roller 202, downstream of the carrying pole 202S2 in the direction of rotation of the developing roller 202.

In the developing roller 202, the separation pole 202N2 is provided opposite the photoconductive drum 201, on both sides of a straight line connecting the rotational center axis 202O of the developing roller 202 and the center 203O of the first mixer 203.

A tangential line V1 to the point of intersection on the side of the separation pole 202N2, of the points of intersection between the outer circumference of the outer roller 202B and the horizontal diameter H1 passing through the rotational center axis 202O of the developing roller 202, that is, the vertical tangential line V1 on the side of the separation pole 202N2 does not meet the first mixer 203.

A tangential line V2 to the point of intersection on the side of the separation pole 202N2, of the points of intersection between a horizontal diameter H2 passing through the center 203O of the first mixer 203 and the outer circumference of the first mixer, that is, the vertical tangential line V2 to the first mixer 203 on the side of the separation pole 202N2 is closer to the center 203O than the tangential line V1 by distance A that is greater than 0.

The center 203O of the first mixer 203 is located more toward the photoconductive drum 201 than the vertical tangential line V1 on the side of the separation pole 202N2.

Here, operation of the developing device 13A of this embodiment will be described.

The first mixer 203 rotates in the direction of arrow X3. The photoconductive drum 201 rotates in the direction of arrow X2.

The catching pole 202N3 draws the developer thereto and attaches the developer to the outer roller 202B. As the outer roller 202B rotates in the direction of arrow X1, the regulating pole 202S1 and the regulating plate 205 regulate the developer to a predetermined thickness.

As the outer roller 202B rotates further, the toner of the developer is supplied to the photoconductive drum 201 at the developing pole 202N1. The developer with the reduced toner concentration is carried to the separation pole 202N2 by the rotating outer roller 202B while being drawn to the carrying pole 202S2.

Since the respective magnets from the catching pole 202N3 to the separation pole 202N2 have the opposite polarities along the direction of rotation of the developing roller 202, the developer remains drawn.

The separation pole 202N2 and the catching pole 202N3 have the same polarity. Therefore, lines of magnetic force are sparse between these poles and the developer becomes separated from the outer roller 202B and free-falls.

Here, in the developing device 13A of this embodiment, the tangential line V1 is located outward from the tangential line V2 and the outer circumference of the first mixer 203, as described above.

The first mixer 203 rotates in the direction of arrow X3 from the position where the developing roller 202 draws the developer toward the position where the separated developer falls.

The developing roller 202 rotates in the direction of arrow X1 from the position of the separation pole 202N2 toward the position where the separated developer free-falls.

Therefore, the developer, separated and free-falling, falls to the position where the developer is stirred by the first mixer 203, and will not be drawn to the outer roller 202B by the catching pole 202N3 before being stirred.

As described above, the image forming apparatus 1 of this embodiment has: the photoconductive drum 201; the first mixer 203 which stirs the developer; and the developing roller which has the plural magnets to supply the stirred developer to the photoconductive drum 201, and the separation pole 202N2, which is a magnet arranged opposite the photoconductive drum 201 in relation to the rotational center axis 202O and separating the developer supplied to the photoconductive drum 201, and which is arranged in a way that the tangential line V1 to the point of intersection on the side of the separation pole 202N2, of the points of intersection between the horizontal diameter H1 and the outer circumference, that is, the vertical tangential line V1 at the side of the separation pole 202N2 is located outward to the side of the separation pole 202N2 from the outer circumference of the first mixer 203.

Thus, the developer, separated and free-falling, falls to the position where the developer is stirred by the first mixer 203, and will not be drawn to the outer roller 202B by the catching pole 202N3 before being stirred. Thus, there is an advantage that deterioration in image quality can be prevented.

While certain embodiments have been described, these embodiments have been presented by way of example only, and are not intended to limit the scope of the inventions. Indeed, the novel methods and apparatuses described herein may be embodied in a variety of other forms; furthermore, various omissions, substitutions and changes in the form of the methods and systems described herein may be made without departing from the spirit of the inventions. The accompanying claims and their equivalents are indeed to cover such forms or modifications as would fall within the scope and spirit of the inventions.

What is claimed is:

1. A developing device comprising:

a developing roller which rotates around a rotational center axis, supplies a developer to an image carrier, using a developing pole that is a magnetic pole arranged within the developing roller to face the image carrier, and separates the developer, using a separation pole that is a magnetic pole arranged downstream of the developing pole along a direction of rotation within the developing roller;

a mixer which is arranged below the developing roller in a way that an outer circumference of the mixer is located more toward the image carrier side than a first tangential line to a point of intersection between a horizontal diameter of the developing roller and an outer circumference thereof on the separation pole side, and which stirs the developer; and a mixer housing configured to house the mixer, having a inner wall disposed so that the first tangential line is inside the inner wall.

2. The device of claim 1, wherein the first tangential line is at a distance greater than 0 to a vertical second tangential line to the mixer on the side of the separation pole; and the developing roller further comprises a catching pole configured to catch the developer disposed at the closest point to the mixer.

3. The device of claim 2, wherein the separation pole is located above a center of the developing roller.

4. The device of claim 3, wherein the separation pole is located opposite the image carrier in relation to the center of the developing roller.

5. The device of claim 4, wherein the center of the mixer is located more toward the image carrier side than the first tangential line.

6. The device of claim 5, wherein the mixer rotates from the side of a catching pole with which the developing roller draws the developer, toward the separation pole side.

7. The device of claim 6, wherein the developing roller rotates from the separation pole toward a position where the developer that is separated free-falls.

8. An image forming apparatus comprising:

an image carrier;

a developing roller which rotates around a rotational center axis, supplies a developer to the image carrier, using a developing pole that is a magnetic pole arranged within the developing roller to face the image carrier, and separates the developer, using a separation pole that is a magnetic pole arranged downstream of the developing pole along a direction of rotation within the developing roller;

a mixer which is arranged below the developing roller in a way that an outer circumference of the mixer is located more toward the image carrier side than a first tangential line to a point of intersection between a horizontal diameter of the developing roller and an outer circumference thereof on the separation pole side, and which stirs the developer; and a mixer housing configured to house the mixer, having a inner wall disposed so that the first tangential line is inside the inner wall.

9. The apparatus of claim 8, wherein the first tangential line is at a distance greater than 0 to a vertical second tangential line to the mixer on the side of the separation pole; and the developing roller further comprises a catching pole configured to catch the developer disposed at the closest point to the mixer.

10. The apparatus of claim 9, wherein the separation pole is located above a center of the developing roller.

11. The apparatus of claim 10, wherein the separation pole is located opposite the image carrier in relation to the center of the developing roller.

12. The apparatus of claim 11, wherein the center of the mixer is located more toward the image carrier side than the first tangential line.

13. The apparatus of claim 12, wherein the mixer rotates from the side of a catching pole with which the developing roller draws the developer, toward the separation pole side.

14. The apparatus of claim 13, wherein the developing roller rotates from the separation pole toward a position where the developer that is separated free-falls.

* * * * *